US010690070B2

(12) United States Patent
Ranga et al.

(10) Patent No.: US 10,690,070 B2
(45) Date of Patent: Jun. 23, 2020

(54) METHOD AND SYSTEM FOR CONTROLLING ENGINE FUELING

(71) Applicant: Ford Global Technologies, LLC, Dearborn, MI (US)

(72) Inventors: Adithya Pravarun Re Ranga, Northville, MI (US); Amey Karnik, Canton, MI (US); Pravin Sashidharan, Troy, MI (US); Gopichandra Surnilla, West Bloomfield, MI (US); Michael Howard Shelby, Plymouth, MI (US); Eric Storhok, Ann Arbor, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 8 days.

(21) Appl. No.: 15/868,674

(22) Filed: Jan. 11, 2018

(65) Prior Publication Data

US 2019/0211761 A1 Jul. 11, 2019

(51) Int. Cl.

*F02D 41/00* (2006.01)
*F02D 41/04* (2006.01)
*F02D 41/14* (2006.01)

(52) U.S. Cl.

CPC ..... *F02D 41/0087* (2013.01); *F02D 41/004* (2013.01); *F02D 41/047* (2013.01); *F02D 41/1401* (2013.01); *F02D 2041/1433* (2013.01); *F02D 2200/0406* (2013.01); *F02D 2200/0604* (2013.01); *F02D 2200/101* (2013.01); *F02D 2200/1002* (2013.01)

(58) Field of Classification Search

CPC .... F02D 41/00; F02D 41/0087; F02D 41/004; F02D 41/14; F02D 41/1401; F02D 2200/101; F02D 2200/0406; F02D 2200/0604; F02D 2041/1433

USPC ..... 123/294–305, 445, 480, 481; 701/102–105, 111–115

See application file for complete search history.

(56) References Cited

U.S. PATENT DOCUMENTS

| | | | | |
|---|---|---|---|---|
| 7,111,593 | B2 | 9/2006 | Song et al. | |
| 7,565,899 | B2 | 7/2009 | Kolmanovsky et al. | |
| 7,954,474 | B2 | 6/2011 | Tripathi et al. | |
| 8,060,293 | B2 | 11/2011 | Meyer et al. | |
| 10,072,600 | B1 * | 9/2018 | Ulrey | F02D 41/3094 |
| 2005/0166900 | A1 * | 8/2005 | Song | F01L 9/04 123/481 |
| 2017/0002761 | A1 * | 1/2017 | Dudar | F02D 41/22 |

* cited by examiner

*Primary Examiner* — John Kwon
*Assistant Examiner* — Johnny H Hoang
(74) *Attorney, Agent, or Firm* — Geoffrey Brumbaugh; McCoy Russell LLP

(57) ABSTRACT

Methods and systems are provided for tracking a fuel puddle mass in the intake port of a deactivated engine cylinder. The difference in fuel evaporation rate in the deactivated cylinder intake is accounted for by applying distinct time constant and gain values to a transient fuel compensation model. A fuel vapor content is clipped once the intake vapor pressure in the intake port of the deactivated cylinder reaches a saturation pressure limit.

6 Claims, 6 Drawing Sheets

METHOD AND SYSTEM FOR CONTROLLING ENGINE FUELING

FIELD

The present description relates generally to methods and systems for controlling fueling of engine cylinders to compensate for fueling dynamics.

BACKGROUND/SUMMARY

Internal combustion engines are controlled to maintain a desired air-to-fuel ratio (AFR) in the combustion chamber to reduce emissions. Fuel is delivered via electronically controlled fuel injectors which may be coupled inside each engine cylinder or located in intake ports of the cylinders, for example. However, not all injected fuel enters the combustion chamber. Rather, some fuel is stored in the intake manifold of the engine resulting in a phenomenon commonly known as "wall wetting". For example, in an engine configured with port fuel injection, fuel is injected into an intake port, on the back of a closed intake valve during a non-inducting stroke of the cylinder. The injected fuel quickly vaporizes due to the heat from the valve and mixes with the intake air, and the air-fuel mixture is then inducted into the cylinder during an intake stroke. However, the vaporization of the fuel in the intake port is a function of the wall temperature and manifold pressure. Consequently, based on the engine operating conditions, the injected fuel will impact the rear of the wall and some part of it will cause wall wetting or puddling of fuel in the port. Some portion of the liquid phase fuel may remain in the port throughout the cycle resulting in a net delay of the fuel injected.

During steady state operation of the engine, the fuel film is in quasi-equilibrium wherein the amount of fuel added to the film each cycle by the fuel injection is equal to the fuel removed by vaporization and liquid film flow. However, if an engine throttle transient occurs, the air flow and fuel injector response may be very fast (e.g., limited only by manifold air dynamics), while the net fuel flow to the engine cylinder may be limited by changes in fuel film properties. The delay of fuel in the intake port can result in an AFR excursion during a throttle transient. Further, the issue may be exacerbated in engines having cylinders that can be selectively deactivated.

Various approaches have been developed for taking into account the fuel puddles in the intake manifold in controlling engine air fuel ratio during steady-state and transient engine operation. One example attempt is shown by Song et al. in U.S. Pat. No. 7,111,593. Therein, transient fuel wall wetting characteristics of an operating engine are determined while accounting for cylinder valve deactivation. In particular, fuel vaporization effects from fuel vapors leaving the fuel puddles of a deactivated cylinder and migrating to active cylinders are considered when calculating the fueling compensation for the active cylinders.

However, the inventors herein have recognized potential issues with such systems. The inducted air-fuel ratio of the active cylinders may incur fluctuations even with the adjustments of Song. As an example, the rate of evaporation of fuel from the puddle of a cylinder may vary based on whether the given cylinder fired and inducted on the last event. If the cylinder did not induct and fire, the number of events elapsed since the last firing event in the given cylinder may also affect the rate of evaporation of fuel from that cylinder's puddle. Further still, the vapor build-up in the port may be affected by the vapor pressure relative to saturation vapor pressure. Specifically, if the cylinder is deactivated for an extended period, all the puddle or film mass may not vaporize. Instead, the vapor build-up in the intake runner of the deactivated cylinder may quickly reach the saturation vapor pressure limit. Thereafter, the vapor pressure build-up may be limited. As another example, any perturbations in manifold pressure can cause the vapor to escape into the engine's intake manifold and cause additional AFR fluctuations.

In one example, the issues described above may be addressed by a method for an engine, comprising: adjusting a fuel injection responsive to reaching a vapor saturation state in a port of a deactivated cylinder of the engine. In this way, fuel dynamics may be determined more accurately.

As one example, an engine may be configured with a variable displacement enabled via selectively deactivatable engine cylinders. Based on the torque demand, the engine may be operated with a different induction ratio, and accordingly, a cylinder may be skipped or fired on each event. For each cylinder, an engine controller may track the estimated fuel puddle mass and fuel vapor content (e.g., the amount of fuel present in liquid phase relative to vapor phase) using calibrated gains and time constants. The gains and time constants may be calibrated via an X-Tau model as a function of engine operating conditions including manifold pressure, engine speed, mass of injected fuel, and engine temperature. The model may assume that metered fuel is proportional to airflow and that a defined percentage of this fuel impacts the existing puddle and forms a liquid film. A rate of evaporation of fuel from this liquid film is determined as a function of the film thickness or size using the X-Tau model. For a deactivated cylinder, with intake and exhaust valves deactivated, a slower evaporation rate occurs due to lower air flow in the runner of the deactivated cylinder. Thus for each skipped cylinder event, a different time constant is applied as compared to an active cylinder. Further, based on the number of skipped events for a cylinder, it may be determined if the fuel vapor pressure has reached a saturation limit (such as when the fuel vapor content reaches a saturation vapor pressure). The saturation pressure is also affected by the port temperature and the manifold pressure. As such, once the saturation limit is reached, further evaporation of fuel from the port may be limited. Therefore, once the saturation limit is reached, the puddle mass and vapor content for the deactivated cylinder may be clipped. For example, no further change in the puddle mass and vapor content may be registered and the last estimated value of puddle fuel mass and vapor content may be maintained until the cylinder inducts upon reactivation. When the deactivated cylinder is reactivated, fueling is resumed in the cylinder as a function of the clipped values of puddle mass and vapor content. For example, fueling is adjusted to compensate for the amount of fuel vapor pressure resulting from the clipped values of puddle mass and vapor content. At the same time, the fuel puddle mass and vapor content in remaining active cylinders may continue to be estimated based on their vapor pressure, independent of the calculations in the deactivated cylinder(s). Thus in the active cylinders, cylinder fueling may continue to be adjusted to account for wall wetting effects of the fuel puddle.

In this way, by adjusting fuel puddle dynamics of a cylinder based on its induction state, deactivated cylinder relative to an active cylinder, transient fuel compensation can be improved. The technical effect of applying different time constants and gains to account for differing rates of evaporation of fuel from active versus skipped cylinders, a fuel puddle volume can be more reliably learned. By clipping the fuel puddle estimate when the vapor pressure at the puddle reaches a saturation vapor pressure limit, cylinder fueling errors are reduced, particularly when a deactivated cylinder resumes fueling. As a result, a more accurate air-fuel ratio control is provided with fewer AFR perturbations. By tracking and updating vapor content and puddle fuel mass at each skipped cylinder event, it may be possible to provide more accurate fueling to cylinders upon reactivation. Overall, the fuel economy of a variable displacement engine may be improved.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
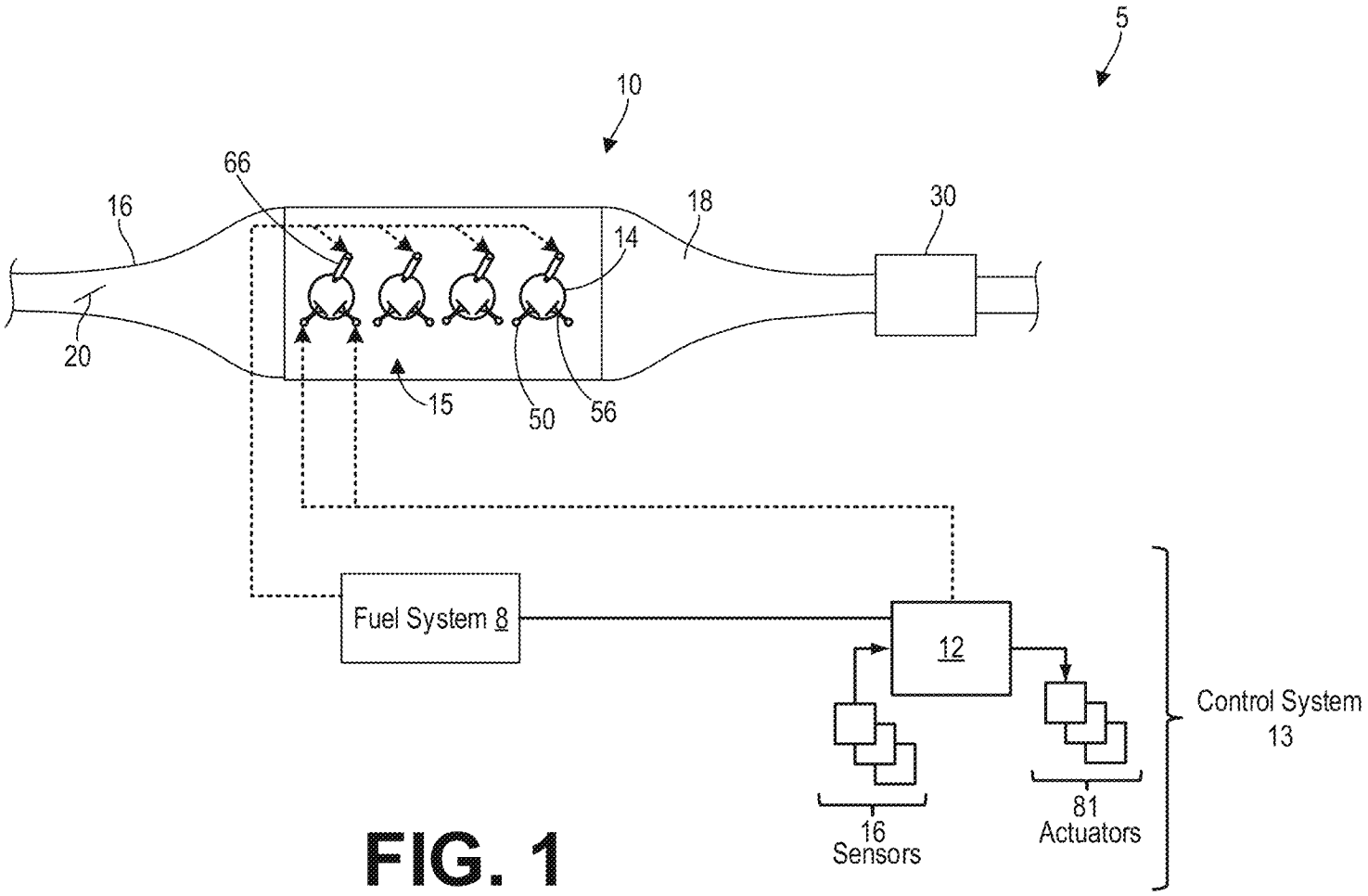
FIG. 1 shows an example embodiment of an engine system layout.
Figure 2:
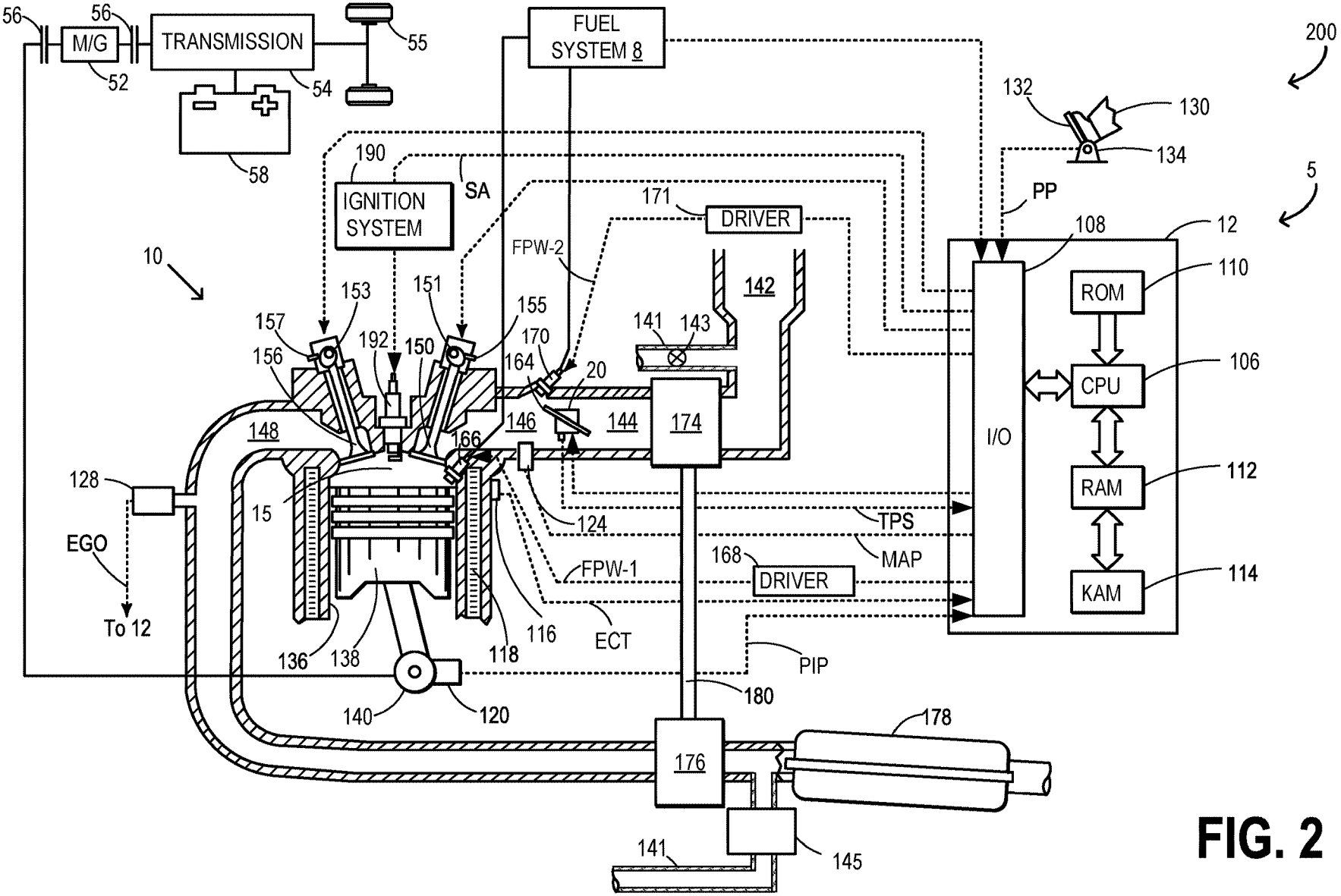
FIG. 2 shows a partial engine view.
Figure 4:
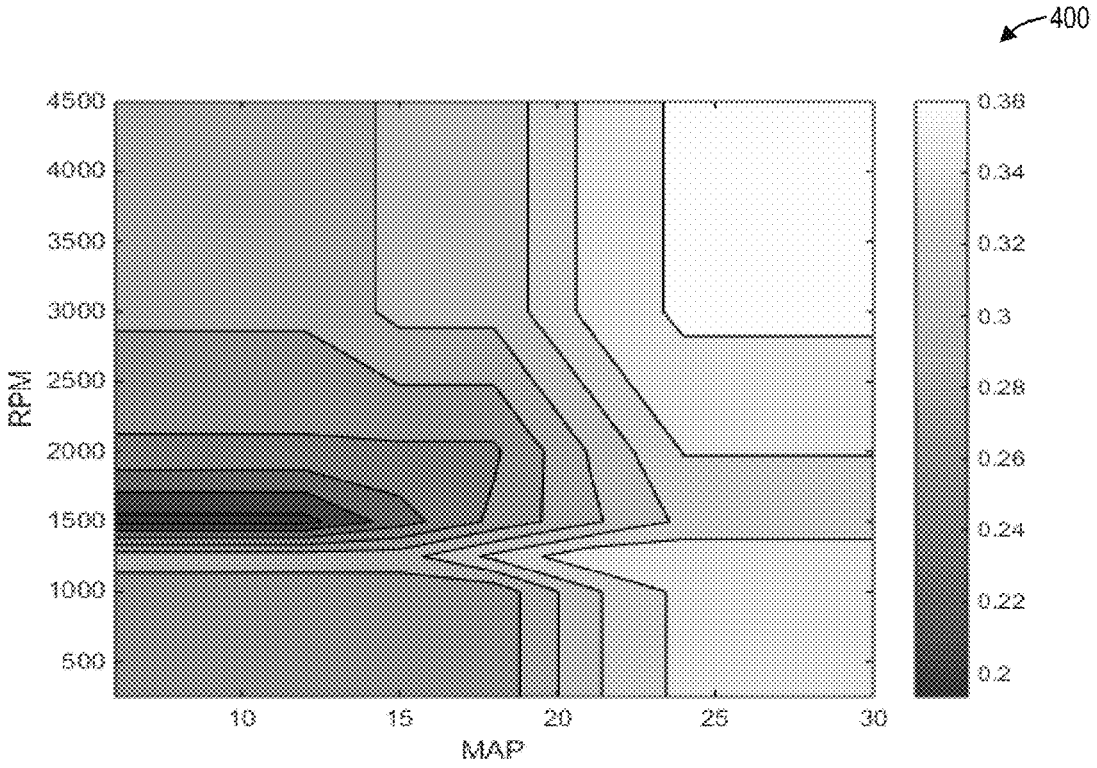
FIG. 4 shows example gain values that may be applied during the estimation of fuel puddle dynamics.
Figure 5:
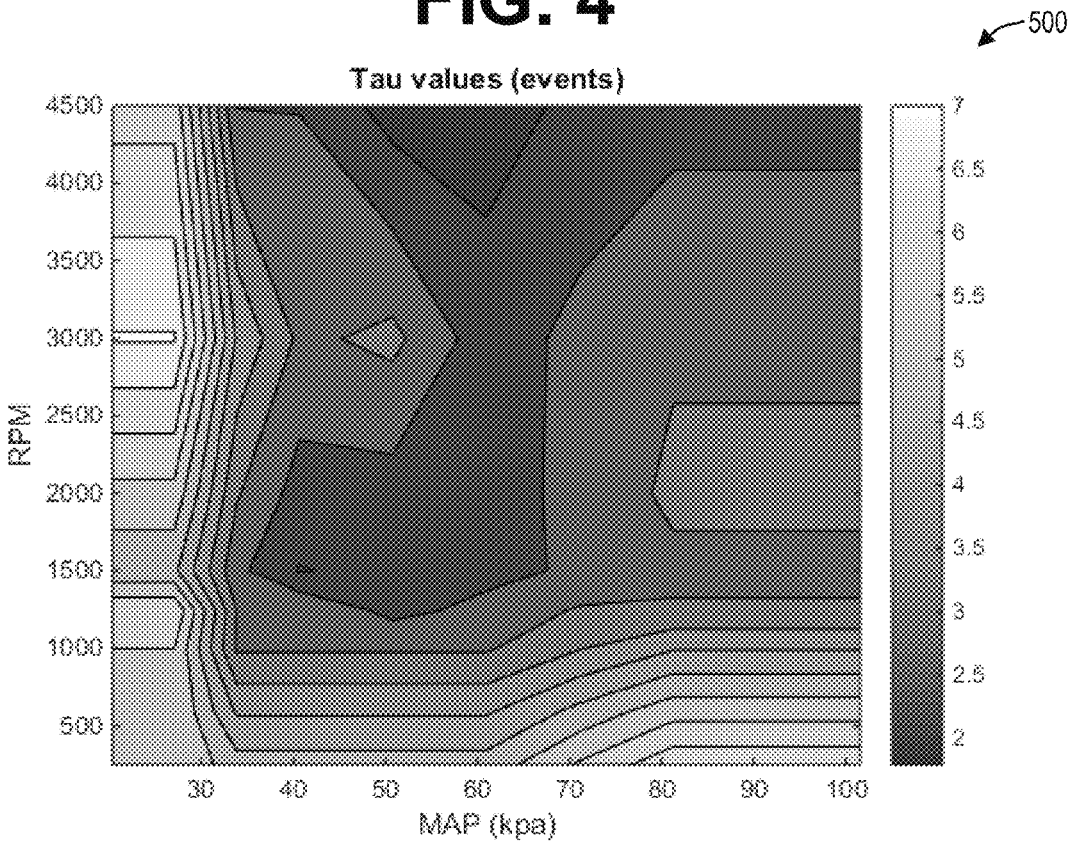
FIG. 5 shows example time constant values that may be applied during the estimation of fuel puddle dynamics.
Figure 6:
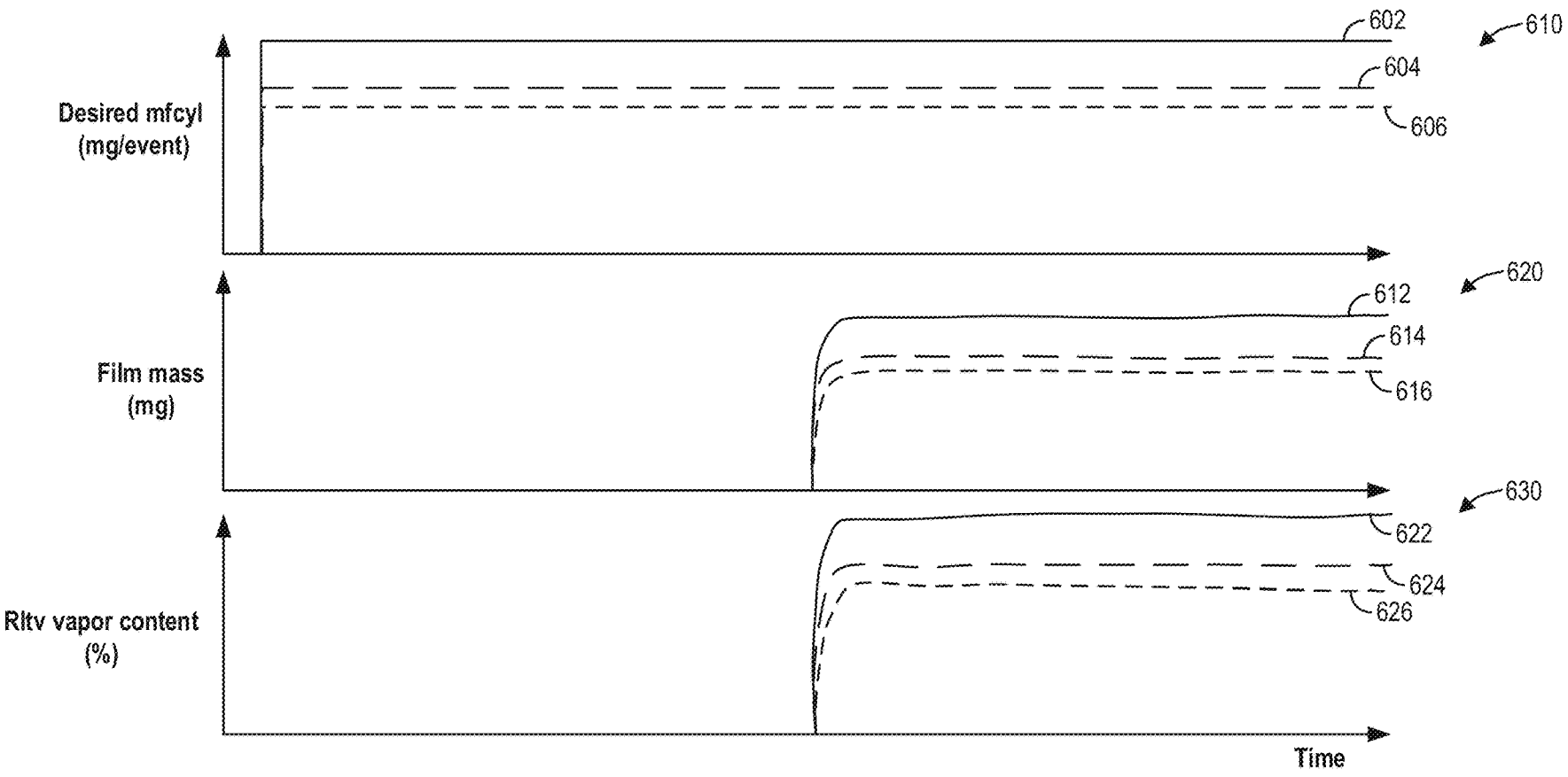
FIG. 6 shows an example change in fuel film mass at a cylinder runner with change in relative vapor content.

Methods and systems are provided for adjusting an amount of fuel delivered to an engine cylinder when operating an engine configured for selective cylinder deactivation, such as the engine system of FIGS. 1 and 2. An engine controller may perform a control routine, such as the example routine of FIG. 3, to update the fuel puddle dynamics of each cylinder based on the induction state of the cylinder as well as based on the firing history of the given cylinder. The controller may select a gain and time constant to apply to a X-Tau model for transient fuel compensation, such as from the maps of FIGS. 4-5, to compensate for differing fuel puddle dynamics of a firing cylinder versus a skipped cylinder. The controller may also clip the fuel puddle mass once the fuel vapor content of a cylinder reaches a saturation vapor pressure limit, as shown in FIG. 6. An example fueling adjustment that takes in account the varying fuel puddle dynamics is shown in the prophetic example of FIG. 7. In this way, air-fuel ratio perturbations associated with incorrect transient fuel compensation are reduced.

FIG. 1 shows an example engine 10 having a cylinder bank 15. In the depicted example, engine 10 is an inline-four (14) cylinder engine with the cylinder bank having four cylinders 14. Engine 10 has an intake manifold 16, with throttle 20, and an exhaust manifold 18 coupled to an emission control system 30. Emission control system 30 includes one or more catalysts and air-fuel ratio sensors, such as described with regard to FIG. 2. As one non-limiting example, engine 10 can be included as part of a propulsion system for a passenger vehicle, such as a hybrid vehicle system 5.

Engine system 10 may have cylinders 14 with selectively deactivatable intake valves 50 and selectively deactivatable exhaust valves 56. In one example, intake valves 50 and exhaust valves 56 are configured for electric valve actuation (EVA) via electric individual cylinder valve actuators. While the depicted example shows each cylinder having a single intake valve and a single exhaust valve, in alternate examples, as elaborated at FIG. 2, each cylinder may have a plurality of selectively deactivatable intake valves and/or a plurality of selectively deactivatable exhaust valves.

During selected conditions, such as when the full torque capability of the engine is not needed, one or more cylinders of engine 10 may be selected for selective deactivation (herein also referred to as individual cylinder deactivation). This may include selectively deactivating one or more cylinders on the cylinder bank 15. The number and identity of cylinders deactivated on the cylinder bank may be symmetrical or asymmetrical. By adjusting the number of cylinders that are deactivated, the induction ratio provided at the engine can be varied.

During the deactivation, selected cylinders may be deactivated by closing the individual cylinder valve mechanisms, such as intake valve mechanisms, exhaust valve mechanisms, or a combination of both. Cylinder valves may be selectively deactivated via hydraulically actuated lifters (e.g., lifters coupled to valve pushrods), via a cam profile switching mechanism in which a cam lobe with no lift is used for deactivated valves, or via the electrically actuated cylinder valve mechanisms coupled to each cylinder. In addition, fuel flow and spark to the deactivated cylinders may be stopped, such as by deactivating cylinder fuel injectors.

In some examples, engine system 10 may have selectively deactivatable (direct) fuel injectors and the selected cylinders may be deactivated by shutting off the respective fuel injectors while maintaining operation of the intake and exhaust valves such that air may continue to be pumped through the cylinders.

While the selected cylinders are disabled, the remaining enabled or active cylinders continue to carry out combustion with fuel injectors and cylinder valve mechanisms active and operating. To meet the torque requirements, the engine produces the same amount of torque on the active cylinders. This requires higher manifold pressures, resulting in lowered pumping losses and increased engine efficiency. Also, the lower effective surface area (from only the enabled cylinders) exposed to combustion reduces engine heat losses, improving the thermal efficiency of the engine.

Cylinders may be deactivated to provide a specific induction (or firing) pattern based on a designated control algorithm. More specifically, selected deactivated working cylinders are not inducting, hence, not firing, while other active working cylinders are inducting, hence, firing. The induction pattern may be defined over one or multiple engine cycles, and would repeat if the same pattern is maintained. The overall pattern may be defined for one cycle of the engine, where for an example of a four-cylinder engine with cylinders having positional numbers 1-4 (with 1 at one end of the line and 4 at the other end of the line) and a firing order of 1-3-4-2 has a pattern of 1-S-4-S, where an "S" represents non-inducting (or deactivation or skipped pattern) and the number means that that cylinder is fueled and fired. Another, different pattern may be S-3-S-2. Still other patterns may be 1-S-S-4, and S-3-4-S, and 1-3-4-S, and 1-S-4-2, and so on. Another case is a pattern that extends over multiple engine cycles, for example 1-S-S-2-S-S-4-S-S-3-S-S, where the patter is changing every cycle to create a rolling pattern. Even if each of these patterns is operated at the same average intake manifold pressure, the cylinder charge for a given cylinder can depend on the induction pattern, and in particular whether the cylinder was firing or non-firing in the previous engine cycle.

Engine 10 may operate on a plurality of substances, which may be delivered via fuel system 8. Engine 10 may be controlled at least partially by a control system 13 including controller 12. Controller 12 may receive various signals from sensors 16 coupled to engine 10 (and described with reference to FIG. 2), and send control signals to various actuators 81 coupled to the engine and/or vehicle (as described with reference to FIG. 2). The actuators may include motors, solenoids, etc., coupled to engine actuators, such as an intake throttle, fuel injector, intake and exhaust valve actuators, etc. The various sensors may include, for example, various temperature, pressure, and air-fuel ratio sensors.

Engine controller 12 may include a drive pulse generator and a sequencer for determining a cylinder pattern based on the desired engine output at the current engine operating conditions. For example, the drive pulse generator may use adaptive predictive control to dynamically calculate a drive pulse signal that indicates which cylinders are to be fired and at what intervals to obtain the desired output (that is, the cylinder firing/non-firing pattern). The cylinder firing pattern may be adjusted to provide the desired output without generating excessive or inappropriate vibration within the engine. As such, the cylinder pattern may be selected based on the configuration of the engine, such as based on whether the engine is a V-engine, an in-line engine, the number of engine cylinders present in the engine, etc. Based on the selected cylinder pattern, the individual cylinder valve mechanisms of the selected cylinders may be closed while fuel flow and spark to the cylinders are stopped.

The engine cylinder induction ratio is an actual total number of cylinder firing events divided by an actual total number of cylinder compression strokes over a predetermined actual total number of cylinder compression strokes. As used herein, cylinder activation event refers to a cylinder firing with intake and exhaust valves opening and closing during a cycle of the cylinder while a cylinder deactivation event refers to a cylinder not firing with intake and exhaust valves held closed during a cycle of the cylinder. An engine event may be a stroke of a cylinder occurring (e.g., intake, compression, power, exhaust), an intake or exhaust valve opening or closing time, time of ignition of an air-fuel mixture in the cylinder, a position of a piston in the cylinder with respect to the crankshaft position, or other engine related event. The engine event number corresponds to a particular cylinder. For example, engine event number one may correspond to a compression stroke of cylinder number one. Engine event number two may correspond to a compression stroke of cylinder number three. A cycle number refers to an engine cycle which includes one event (activation or deactivation) in each cylinder. For example, a first cycle is completed when an engine event has elapsed in each cylinder of the 8-cylinder engine (a total of eight engine events), in the firing order. The second cycle starts when a second engine event occurs in a first cylinder of the firing order (that is, the ninth engine event counting from an initial engine event).

The decision to activate or deactivate a cylinder and open or close the cylinder's intake and exhaust valve may be made a predetermined number of cylinder events (e.g., one cylinder event, or alternatively, one cylinder cycle or eight cylinder events) before the cylinder is to be activated or deactivated to allow time to begin the process of opening and closing intake and exhaust valves of the cylinder being evaluated. For example, for an eight cylinder engine with a firing order of 1-3-7-2-6-5-4-8, the decision to activate or deactivate cylinder number seven may be made during an intake or compression stroke of cylinder number seven one engine cycle before cylinder number seven is activated or deactivated. Alternatively, the decision to activate or not activate a cylinder may be made a predetermined number of engine events or cylinder events before the selected cylinder is activated or deactivated.

Turning now to FIG. 2, an example embodiment 200 of a combustion chamber or cylinder of internal combustion engine 10 (such as engine 10 of FIG. 1) is shown. Components previously introduced in FIG. 1 may be similarly numbered. Engine 10 may be coupled to a propulsion system, such as vehicle system 5 configured for on-road travel. Engine 10 may receive control parameters from a control system including controller 12 (such as controller 12 of FIG. 1) and input from a vehicle operator 130 via an input device 132. In this example, input device 132 includes an accelerator pedal and a pedal position sensor 134 for generating a proportional pedal position signal PP. Cylinder (herein also "combustion chamber") 14 of engine 10 may include combustion chamber walls 136 with piston 138 positioned therein. Piston 138 may be coupled to crankshaft 140 so that reciprocating motion of the piston is translated into rotational motion of the crankshaft. Crankshaft 140 may be coupled to at least one drive wheel of the passenger vehicle via a transmission system (not shown).

Cylinder 14 can receive intake air via a series of intake air passages 142, 144, and 146. Intake air passage 146 may communicate with other cylinders of engine 10 in addition to cylinder 14. In some embodiments, one or more of the intake passages may include a boosting device such as a turbocharger or a supercharger. For example, FIG. 2 shows engine 10 configured with a turbocharger including a compressor 174 arranged between intake passages 142 and 144, and an exhaust turbine 176 arranged along exhaust passage 148. Compressor 174 may be at least partially powered by exhaust turbine 176 via a shaft 180 where the boosting device is configured as a turbocharger. However, in other examples, such as where engine 10 is provided with a supercharger, exhaust turbine 176 may be optionally omitted, where compressor 174 may be powered by mechanical input from a motor or the engine. A throttle 20 including a throttle plate 164 may be provided along an intake passage of the engine for varying the flow rate and/or pressure of intake air provided to the engine cylinders. For example, throttle 20 may be disposed downstream of compressor 174 or alternatively may be provided upstream of compressor 174.

Exhaust passage 148 may receive exhaust gases from other cylinders of engine 10 in addition to cylinder 14. Exhaust gas sensor 128 is shown coupled to exhaust passage 148 upstream of emission control device 178, which is part of emission control system 30, as shown in FIG. 1. Exhaust gas sensor 128 may be selected from among various suitable sensors for providing an indication of exhaust gas air/fuel ratio such as a linear oxygen sensor or UEGO (universal or wide-range exhaust gas oxygen), a two-state oxygen sensor or EGO (as depicted), a HEGO (heated EGO), a NOx, HC, or CO sensor, for example. Emission control device 178 may be a three way catalyst (TWC), NOx trap, various other emission control devices, or combinations thereof.

Each cylinder of engine 10 may include one or more intake valves and one or more exhaust valves. For example, cylinder 14 is shown including at least one poppet-style intake valve 150 and at least one poppet-style exhaust valve 156 located at an upper region of cylinder 14. In some embodiments, each cylinder of engine 10, including cylinder 14, may include at least two intake poppet valves and at least two exhaust poppet valves located at an upper region of the cylinder.

Intake valve 150 may be controlled by controller 12 by cam actuation via cam actuation system 151. Similarly, exhaust valve 156 may be controlled by controller 12 via cam actuation system 153. Cam actuation systems 151 and 153 may each include one or more cams and may utilize one or more of cam profile switching (CPS), variable cam timing (VCT), variable valve timing (VVT), and/or variable valve lift (VVL) systems that may be operated by controller 12 to vary valve operation. The operation of intake valve 150 and exhaust valve 156 may be determined by valve position sensors (not shown) and/or camshaft position sensors 155 and 157, respectively. In alternative embodiments, the intake and/or exhaust valve may be controlled by electric valve actuation. For example, cylinder 14 may alternatively include an intake valve controlled via electric valve actuation and an exhaust valve controlled via cam actuation including CPS and/or VCT systems. In still other embodiments, the intake and exhaust valves may be controlled by a common valve actuator or actuation system, or a variable valve timing actuator or actuation system.

As elaborated with reference to FIG. 1, engine 10 may be a variable displacement engine wherein the intake and exhaust valves are selectively deactivatable responsive to operator torque demand to operate the engine at a desired induction ratio, with a selected cylinder deactivation (or firing) pattern.

In some embodiments, each cylinder of engine 10 may include a spark plug 192 for initiating combustion. Ignition system 190 can provide an ignition spark to cylinder 14 via spark plug 192 in response to spark advance signal SA from controller 12, under select operating modes. In other embodiments, such as where cylinder combustion is initiated using compression ignition, the cylinder may not include a spark plug.

In some embodiments, each cylinder of engine 10 may be configured with one or more injectors for delivering fuel to the cylinder. As a non-limiting example, cylinder 14 is shown including two fuel injectors 166 and 170. Fuel injectors 166 and 170 may be configured to deliver fuel received from fuel system 8 via a high pressure fuel pump, and a fuel rail. Alternatively, fuel may be delivered by a single stage fuel pump at lower pressure, in which case the timing of the direct fuel injection may be more limited during the compression stroke than if a high pressure fuel system is used. Further, the fuel tank may have a pressure transducer providing a signal to controller 12.

Fuel injector 166 is shown coupled directly to cylinder 14 for injecting fuel directly therein in proportion to the pulse width of signal FPW-1 received from controller 12 via electronic driver 168. In this manner, fuel injector 166 provides what is known as direct injection (hereafter referred to as "DI") of fuel into combustion cylinder 14. While FIG. 2 shows injector 166 positioned to one side of cylinder 14, it may alternatively be located overhead of the piston, such as near the position of spark plug 192. Such a position may improve mixing and combustion when operating the engine with an alcohol-based fuel due to the lower volatility of some alcohol-based fuels. Alternatively, the injector may be located overhead and near the intake valve to improve mixing.

As elaborated with reference to FIG. 2, engine 10 may be a variable displacement engine wherein fuel injector 166 is selectively deactivatable responsive to operator torque demand to operate the engine at a desired induction ratio, with a selected cylinder deactivation (or firing) pattern.

Fuel injector 170 is shown arranged in intake passage 146, rather than in cylinder 14, in a configuration that provides what is known as port injection of fuel (hereafter referred to as "PFI") into the intake port upstream of cylinder 14. Fuel injector 170 may inject fuel, received from fuel system 8, in proportion to the pulse width of signal FPW-2 received from controller 12 via electronic driver 171. Note that a single electronic driver 168 or 171 may be used for both fuel injection systems, or multiple drivers, for example electronic driver 168 for fuel injector 166 and electronic driver 171 for fuel injector 170, may be used, as depicted.

Fuel may be delivered by both injectors to the cylinder during a single cycle of the cylinder. For example, each injector may deliver a portion of a total fuel injection that is combusted in cylinder 14. As such, even for a single combustion event, injected fuel may be injected at different timings from the port and direct injector. Furthermore, for a single combustion event, multiple injections of the delivered fuel may be performed per cycle. The multiple injections may be performed during the compression stroke, intake stroke, or any appropriate combination thereof.

As described above, FIG. 2 shows only one cylinder of a multi-cylinder engine. As such, each cylinder may similarly include its own set of intake/exhaust valves, fuel injector(s), spark plug, etc. It will be appreciated that engine 10 may include any suitable number of cylinders, including 2, 3, 4, 5, 6, 8, 10, 12, or more cylinders. Further, each of these cylinders can include some or all of the various components described and depicted by FIG. 2 with reference to cylinder 14.

The engine may further include one or more exhaust gas recirculation passages for recirculating a portion of exhaust gas from the engine exhaust to the engine intake. As such, by recirculating some exhaust gas, an engine dilution may be affected which may improve engine performance by reducing engine knock, peak cylinder combustion temperatures and pressures, throttling losses, and NOx emissions. In the depicted embodiment, exhaust gas may be recirculated from exhaust passage 148 to intake passage 144 via EGR passage 141. The amount of EGR provided to intake passage 144 may be varied by controller 12 via EGR valve 143. Further, an EGR sensor 145 may be arranged within the EGR passage and may provide an indication of one or more of pressure, temperature, and concentration of the exhaust gas.

In some examples, vehicle system 5 may be a hybrid vehicle with multiple sources of torque available to one or more vehicle wheels 55. In other examples, vehicle system 5 is a conventional vehicle with only an engine, or an electric vehicle with only electric machine(s). In the example shown, vehicle system 5 includes engine 10 and an electric machine 52. Electric machine 52 may be a motor or a motor/generator. Crankshaft 140 of engine 10 and electric machine 52 are connected via a transmission 54 to vehicle wheels 55 when one or more clutches 56 are engaged. In the depicted example, a first clutch 56 is provided between crankshaft 140 and electric machine 52, and a second clutch 56 is provided between electric machine 52 and transmission 54.

Controller 12 may send a signal to an actuator of each clutch 56 to engage or disengage the clutch, so as to connect or disconnect crankshaft 140 from electric machine 52 and the components connected thereto, and/or connect or disconnect electric machine 52 from transmission 54 and the components connected thereto. Transmission 54 may be a gearbox, a planetary gear system, or another type of transmission. The powertrain may be configured in various manners including as a parallel, a series, or a series-parallel hybrid vehicle.

Electric machine 52 receives electrical power from a traction battery 58 to provide torque to vehicle wheels 55. Electric machine 52 may also be operated as a generator to provide electrical power to charge battery 58, for example during a braking operation.

Controller 12 is shown as a microcomputer, including microprocessor unit 106, input/output ports 108, an electronic storage medium for executable programs and calibration values shown as read-only memory chip 110 in this particular example, random access memory 112, keep alive memory 114, and a data bus. Controller 12 may receive various signals from sensors coupled to engine 10, in addition to those signals previously discussed, including measurement of engine coolant temperature (ECT) from temperature sensor 116 coupled to cooling sleeve 118; a profile ignition pickup signal (PIP) from Hall effect sensor 120 (or other type) coupled to crankshaft 140; throttle position (TPS) from a throttle position sensor; and manifold absolute pressure signal (MAP) from sensor 124. Engine speed signal, RPM, may be generated by controller 12 from signal PIP. Manifold pressure signal MAP from a manifold pressure sensor may be used to provide an indication of vacuum, or pressure, in the intake manifold. Still other sensors may include fuel level sensors and fuel composition sensors coupled to the fuel tank(s) of the fuel system.

Storage medium read-only memory chip 110 can be programmed with computer readable data representing instructions executable by microprocessor unit 106 for performing the methods described below as well as other variants that are anticipated but not specifically listed.

The controller 12 receives signals from the various sensors of FIGS. 1-2 and employs the various actuators of FIGS. 1-2 to adjust engine operation based on the received signals and instructions stored on a memory of the controller. For example, responsive to an operator torque command, as inferred from the pedal position sensor, the controller may send a signal to a throttle actuator to adjust a throttle opening, the opening increased as the torque demand increases. As another example, responsive to a desired induction ratio determined based on operator torque demand, the controller may send signals to selected cylinder fuel injectors and valves to selectively deactivate those cylinders in accordance with a cylinder deactivation pattern that provides the desired induction ratio.

As such, not all of the port injected fuel enters the combustion chamber. Some of the fuel is stored in the intake manifold of the engine, such as in the intake port. This phenomenon is known as wall wetting. In particular, fuel is injected from the port injector on the back of the closed intake valve during a non-inducting stroke of the respective cylinder. The port injected fuel quickly vaporizes due to the heat from the valve and mixes with the intake, and the mixture is inducted into the cylinder during the intake stroke. Since this vaporization of the fuel in the port is a function of the wall temperature and manifold pressure, under certain engine operating conditions, this injected fuel may impact the rear of the wall and some part of it will cause wall wetting or puddling of fuel in the port. Some portion of the liquid phase fuel may remain in the port throughout the cycle resulting in a net delay of the fuel injected. During steady state operation of the engine, the fuel film is in quasi-equilibrium wherein the amount of fuel added to the film each cycle by the fuel injection is equal to the fuel removed by vaporization and liquid film flow. However, if an engine throttle transient occurs, the air flow and fuel injector response is very fast (limited only by manifold air dynamics), but the net fuel flow to the engine cylinder is limited by changes in fuel film properties. The delay of fuel in the port results in an Air/Fuel Ratio (AFR) excursion during a throttle transient. To reduce AFR excursions caused due to transient operation, the controller may accurately estimate the mass of the fuel puddle on each intake port for each cylinder event using, for example, an X-Tau model for transient fuel control, a Gain-Time constant model, and/or a multi component puddle model as "wall wetting". As elaborated with reference to the routine of FIG. 3, the controller may further adjust the model parameters based on whether the cylinder was fired or skipped on a given cylinder event, thereby accounting for the differences in fuel evaporation rate from firing or skipped cylinder ports.

In this way, the components of FIGS. 1 and 2 provides an engine system comprising a first cylinder; a second cylinder; a first fuel injector coupled to a first intake port of the first cylinder; a second fuel injector coupled to a second intake port of the second cylinder; and a controller. The controller may be configured with computer readable instructions stored on non-transitory memory for: responsive to a drop in torque demand, selectively deactivating the second cylinder while continuing to fuel the first cylinder for a number of cylinder events; and on each event for the number of cylinder events, updating a value of a first fuel puddle in the first intake port via a first set of fuel evaporation constants; updating a value of a second fuel puddle in the second intake port via a second, different set of fuel evaporation constants until the fuel puddle is at a saturation limit, and then maintaining the value of the second fuel puddle; and adjusting a pulse-width commanded to the first fuel injector based on the value of the first fuel puddle. The controller may additionally, responsive to a rise in the torque demand, reactivate the second cylinder; and adjust the pulse-width commanded to the second fuel injector based on the value of the second fuel puddle. In further examples, updating the value of the first fuel puddle in the first intake port may include updating each of a fuel puddle mass and a fuel vapor pressure in the first intake port, and updating the value of the second fuel puddle in the second intake port may include updating each of the fuel puddle mass and the fuel vapor pressure in the second intake port, wherein the fuel puddle being at the saturation limit includes the fuel vapor pressure in the second intake port being at a saturation vapor pressure. In another example, the controller may include further instructions for calculating the saturation vapor pressure based on each a fuel alcohol content, a temperature of the second intake port, and ambient pressure. The controller may also include further instructions for retrieving the first set of fuel evaporation constants from the memory as a function of engine speed and load; and calculating the second set of fuel evaporation constants as a function of engine speed and load; and using either the first or the second set based upon the activation state of the corresponding cylinder.

Figure 3:
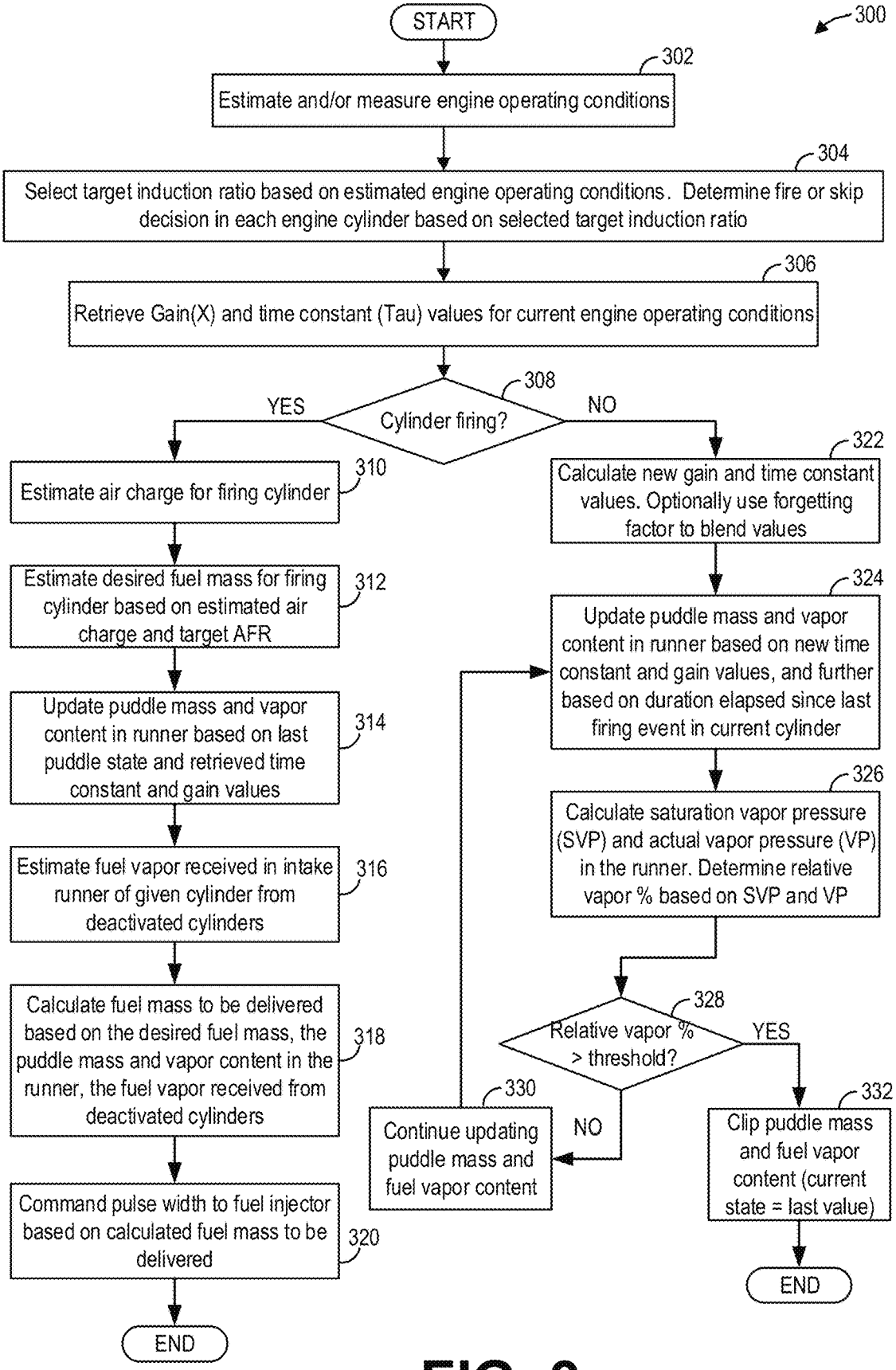
FIG. 3 shows a high level flowchart of an example method for updating fuel puddle dynamics for each cylinder based on an induction state of the cylinder.

Turning now to FIG. 3, a method 300 for accurately estimating fuel puddle dynamics before a cylinder fueling event is shown. The method enables cylinder fueling to be accurately controlled while accounting for wall wetting effects. Instructions for carrying out method 300 and the rest of the methods included herein may be executed by a controller based on instructions stored on a memory of the controller and in conjunction with signals received from sensors of the engine system, such as the sensors described above with reference to FIGS. 1-2. The controller may employ engine actuators of the engine system to adjust engine operation, according to the methods described below. It will be appreciated that the routine of FIG. 3 may be reiterated before each cylinder event during engine operation.

At 302, the method includes estimating and/or measuring engine operating conditions. These may include, for example, vehicle speed, engine speed, engine load, accelerator pedal position, operator torque demand, ambient conditions including ambient temperature, humidity, and pressure, boost, EGR, manifold pressure, manifold air flow, etc. The operator torque demand may be based on accelerator pedal position and vehicle speed. For example, accelerator pedal position and vehicle speed may be a basis for indexing a table or function in controller memory. The table or function outputs an operator requested engine torque from empirically determined values stored in the table.

At 304, a target induction ratio or desired engine cylinder firing fraction may be selected based on the engine operating conditions. For example, as the operator torque demand decreases, the number of cylinders that needs to be fired to meet the torque demand may be reduced, and the number of cylinders that may be skipped (that is, operated with fuel selectively deactivated) while meeting the torque demand may be increased. As used herein, the desired engine cylinder firing fraction or target induction ratio refers to the ratio of a total number of cylinder events that are inducting divided by the total number of cylinder compression strokes over a predetermined actual total number of cylinder compression strokes. In one example, the target induction is determined from the requested engine torque. In particular, allowable induction ratio values may be stored in a table or function that may be indexed by desired engine torque and engine speed.

In addition to selecting the target induction ratio, the controller may also determine a fire or skip decision for each cylinder based on the selected induction ratio. For example, a decision is made for the next cylinder event and it is determined whether to induct or skip the cylinder in the upcoming cylinder event so as to support the desired induction ratio. The decision is made in accordance with the prior induction history of the engine and the desired induction ratio. If the induction ratio is held constant for a long time, the resulting decisions will deliver the pattern that corresponds to the induction ratio. In other words, the controller makes a decision to fire or skip at the next cylinder event so to provide the determined target induction ratio. In one example, if the most recent cylinder event was a firing event, and if the target induction ratio requires the next cylinder event to be an inducting event, the next cylinder is inducted and fired. Else, if the target induction ratio requires the next cylinder event to be a skipped event, the next cylinder is skipped and not fired. In some examples, a cylinder deactivation pattern that provides the target induction ratio or desired engine cylinder firing fraction may also be selected.

At 306, the method includes retrieving parameters for modeling the wall wetting. In particular, a first set of model parameters may be retrieved. In one example, the first set of model parameters may be default set that is determined as a function of engine speed and load. As an example, the controller may retrieve a gain factor (e.g., X) and a fuel evaporation time constant (e.g., Tau) for the wall wetting model. The values may be retrieved from a look-up table stored in the controller's memory. The gain and Tau values may be predetermined as a function of engine speed and MAP. These values may be adjusted based on the intake manifold runner control (IMRC), variable cam timing (VCT) position, and estimated valve temperature. In cylinder deactivation mode, these parameters may be further adjusted as a function of number of engine cycles or events the cylinder has been disabled.

At 308, it may be determined if the next cylinder event is a firing event or a skipped event. In particular, based on the selected induction ratio, it may be determined if the next cylinder will combust fuel or not. In one example, if the induction ratio is 1.0, all cylinders are operated and the next cylinder is a firing event. In another example, if the induction ratio is 0.5, every other cylinder is skipped. Thus, if the previous cylinder event was a firing event, the upcoming cylinder event may be a skipped event. Likewise, if the previous cylinder event was a skipped event, the upcoming cylinder event may be a firing event.

If the next cylinder event is a firing event, then at 310, the method includes estimating the air charge for the firing cylinder (m_air). In one example, estimating the air charge for the firing cylinder includes measuring the intake manifold pressure and using engine volumetric efficiency characterization to infer the amount of air trapped in the cylinder. The air charge estimate may be modified based upon the prior deactivation history of the cylinder. At 312, the method includes estimating the desired fuel mass for the firing cylinder based on the estimated cylinder air charge and the target air-fuel ratio (AFR). In one example, where the target AFR is stoichiometry, the desired fuel mass for the cylinder (Mf_desired) may be calculated based on the estimated cylinder air charge to provide a ratio of air charge:fuel mass of 14.7:1. Still other AFRs, such as richer than stoichiometry (more air than stoichiometry) or leaner than stoichiometry (more air than stoichiometry) may be possible and the fuel mass calculation may be adjusted accordingly. The target AFR may also be selected based on engine operating conditions. As an example, the desired fuel mass for a stoichiometric AFR may be determined as: Mf_desired=AFR_stoic*air.

At 314, the method includes updating the puddle mass and vapor content in the intake runner of the firing cylinder based on the last estimated puddle state and the retrieved time constant and gain values. Herein the retrieved time constant and gain values may be a first set of time constant and gain values. In one example, the updating includes estimating the puddle mass and vapor content via a model, such as an X-Tau model while applying a first set of model parameters (in this example, the first set of time constant and gain values) due to the cylinder being active. In one example, the retrieved gain value applied may be 0.07 while the retrieved time constant may be 4. The first set of model parameters may include other parameters such as engine coolant temperature (ECT), IMRC and VCT compensation gains. The first set of model parameters may be based on engine speed and load, ECT, IMRC position, VCT position, induction state of the cylinder and/or the number of events the cylinder has been off. As an example, the controller may update the puddle mass by accounting for the fuel that has evaporated from the previous puddle and the additional fuel added into the puddle during current injection. The net fuel in the puddle is used for subsequent transient fuel calculations. In this way, the controller may estimate each of fuel puddle mass and fuel vapor content in an intake port of each cylinder on a cylinder event basis including based on an induction state of each cylinder.

At 316, the controller may estimate the fuel vapor received in the intake runner of the given cylinder from adjacent deactivated cylinders. In particular, the controller may estimate a migration of fuel from one or more deactivated engine cylinders to the given active cylinder of the engine. At 318, the controller may calculate the fuel mass to be delivered to the firing cylinder based on the desired fuel mass, the puddle mass and fuel vapor content, and the fuel vapor received from the deactivated cylinders. Optionally, the transient fueling compensation value can be combined with feedback corrections from an exhaust gas oxygen sensor to allow the combustion air-fuel ratio to more accurately approach the target air-fuel ratio. The feedback can be of a proportional and integral type, or another appropriate form. Further, additional feedforward compensation, such as to compensate for airflow dynamics, can also be used. For example, the controller may adjust fueling to the given active cylinder based on the estimated fuel puddle mass, fuel vapor content, and fuel migration, as elaborated below. At 320, the method includes adjusting at least an amount of fuel that is port injected to the given active cylinder based on the estimated fuel puddle mass and fuel vapor content. For example, a pulse width signal may be commanded to the fuel injector (e.g., port fuel injector) coupled to the firing cylinder, the signal corresponding to the calculated fuel mass to be delivered. In one example, as the fuel puddle mass and vapor content increases, the amount of fuel that needs to be port injected may be reduced, and a pulse-width commanded to the port fuel injection may be correspondingly decreased. In still other examples, a direct fuel injection amount may be reduced.

In general terms, a cylinder (or intake port) specific transient fuel model may be used to derive the fuel injection compensation for the firing cylinders. The parameters $\chi$ and $\tau$ are used to describe the transient behavior of injected fuel and a fuel film at the intake port. However, a distinct set of $\chi$ and $\tau$ values are retrieved for each cylinder/intake port. The model assumes a portion $(1-\chi)$ of the mass flow rate of injected liquid fuel (dmf/dt) enters the cylinder, while the remainder ($\chi$dmf/dt) stays on the surface of intake port/ports, which forms a liquid film or puddle mass. In addition, the vapor from fuel left over in the intake port can also be included in this model and can contribute to the fuel mass in intake port (mp), so the fuel puddle mass at the intake port can have a broader meaning. The fueling dynamic model uses a mass balance of fuel for each intake port, the model development shown using the equations herein. Specifically, a mass balance is written on a fuel injector/intake port/cylinder basis. The amount of fuel entering is the mass flow rate of fuel injected from the injector (dmf/dt). The mass flow rate of fuel exiting the puddle is denoted as (dme/dt), which is assumed proportional (via parameter $1/\tau$) to the mass of fuel in the puddle (mp). Writing the mass balance while substituting for the flow entering the cylinder gives:

$$dmp/dt=\chi dmf/dt-mp/\tau$$

However, while a time based model/compensation can be used, a discrete format (event-based) can also be used in engine control applications. The event-based approach gives:

$$mp(k+1)=mp(k)+\chi mf(k)-mp(k)/Nr$$

where k is the event index, e.g., updated at every firing of the engine, or every engine revolution, or after a certain amount of crank (or cam) shaft rotation, mp is the mass of fuel leftover in the intake port; and $\chi$ is the portion of the injected fuel that stays in the intake port either in liquid film form or vapor form, mf is the fuel amount injected into the intake port during a given sample period, Nr is the characteristic time of fuel evaporation in the number of engine events, and $\tau$ is the time constant that describes the velocity of fuel in the intake port leaving the intake port.

At steady state, the amount of fuel trapped in the intake port is equal to the amount of fuel leaving the intake port, which is called an equilibrium state. At an equilibrium state, the injected fuel equals the inducted fuel into the cylinder. As indicated above, the fuel mass flow into cylinder (dmfcyl/dt) that joins combustion process can be described via following equation as the sum of the fuel exiting the puddle, and the portion from the injector not entering the puddle:

$$dmfcyl/dt=(1-\chi)dmf/dt+mp/\tau$$

where dmfcyl/dt is fuel mass flow into cylinder.

Note that transportation delays in fuel injection, induction, combustion, and exhaust can be added, if desired.

Returning to 308, if the upcoming cylinder event is not a firing event, but a skipped event, then the method moves to estimate each of fuel puddle mass and fuel vapor content in an intake port of the skipped cylinder on a cylinder event basis based on the deactivated induction state of the cylinder. The estimating may include estimating includes estimating via a model, by applying a second, different set of model parameters when the cylinder is deactivated (as compared to the first set of model parameters applied for an active cylinder), the model parameters including one or more of a fuel evaporation time constant and gain value.

In particular, at 322, the method includes the controller using a forgetting factor ($\gamma$) to calculate new values for gain and time constant. The forgetting factor may be a blending rate that is used to calculate new values by blending between the values for the active cylinder (X, tau for active cylinder) and those for the deactivated cylinder (X, tau for deactivated cylinder). Ideally, there should be no blending between the two, since it is an event based phenomena. As an example, when the forgetting factor or blending rate is 1, the values may switch instantaneously. This may be recommended calibration for all non-stationary patterns. The blending rate may be useful for software VDE systems.

As an example, the first set of values applied during the fuel compensation of the firing cylinder may be disregarded, and instead, a second set of values may be selected and applied. The controller may use the forgetting factor to calculate the second set of model parameter values by blending the first set of parameter values for an active cylinder with a first set of parameter values for a deactivated cylinder. While the first set of model parameters are based on engine speed and load, the second set of model parameters may be based on the amount of vapor in the ports and the numbers of events the cylinder has been disabled. In one example, the evaporation time constant and gain value in the first set (used for the active cylinder) is smaller than the evaporation time constant and gain value in the second set used for the deactivated cylinder. Alternatively, the new (second set) of time constant and gain values may be retrieved from a map, such as the maps of FIGS. 4-5. Maps 400 and 500 depict example gain and time constant values, respectively, for a base warmed up engine (e.g., where the ECT is 180 degrees Celsius). In one example, the new gain value applied may be ~0.2-0.4 while the new time constant may be ~2-7 events. The time constant may be expressed in terms of events to derive the compensation based on the number of events the cylinder is off. The number of events in the calibration is adjusted to take into consideration the RPM effect.

At 324, the puddle fuel mass and vapor content in the runner of the deactivated cylinder may be updated based on the new time constant and gain values, and further based on a duration elapsed since the last firing event in the current cylinder. For example, fuel vapor content may be increased as a duration elapsed since a last firing event in the deactivated cylinder increases.

For an engine with VDE capability, some of the anticipated dynamics that may occur during cylinder deactivation in terms of puddle mass evaporation from the port include evaporation rate change, vapor build-up in the port, and vapor escape into other cylinders. With no air flow in the port of the deactivated cylinder, the evaporation rate for the fuel film in the port from a last fire event could be different compared to an inducting cylinder with constant airflow. Therefore at least the time constant value of the deactivated cylinder may set to be different. In addition, if a specific cylinder is deactivated for multiple events, the vapor building up in the intake runner could quickly reach the saturation vapor pressure limits. Thereafter, any possible perturbations in the MAP could cause the vapor to escape into the intake manifold and cause AFR fluctuations for other inducting cylinders. To address the potential effect on AFR control due to puddle mass estimation and transient fueling control for VDE engines, the transient fuel compensation model may be adjusted with new time constant and gain values when updating the puddle mass for deactivated cylinders. By updating the algorithm, a software only solution to accurately compensate fueling affected by puddle mass/vapor content in the intake for a deactivated cylinder can be provided.

In the updated fuel puddle mass and vapor content estimation for the deactivated cylinder, it is assumed that metered fuel is proportional to airflow and some percentage ('X') of this fuel impacts the existing puddle and forms a liquid film. Also it is assumed that fuel vaporizes from this liquid film and this rate of evaporation is dependent on the film thickness/size. The continuity equation is written as a X-Tau model $$\frac{dm_p}{dt} = X * \frac{dm_f}{dt} - (1/\tau) * m_p,$$

wherein X is determined as a function of MAP, ECT, and engine speed, $\tau$ is determined as a function of MAP, ECT, and intake airflow. For example, the controller may refer a look-up table that computes the values of X and $\tau$ as a function of the corresponding parameters. Also in the above equation, Mp is the mass of the fuel puddle, and Mf is the mass of fuel injected per cylinder.

To track the fuel puddle and vapor in the intake, per cycle, for each current event "k" and for a cylinder/injector "i", the amount of desired fuel mass may be represented as '$mf_{des}(k, i)$', the puddle mass is represented as '$m_p(k, i)$', the vapor mass is represented as '$m_{vap}(k, i)$', the actual injected fuel is represented as '$mf_{inj}(k, i)$', the inducted fuel into the cylinder is represented as '$mf_{cyl}(k,i)$', and $X_k$ & $\tau_k$ represent the respective fuel fraction and time constant values for the current firing event.

Hence for the current event:

$$m_p(k, i) = m_p(k-1, i) + X_k * mf_{inj}(k-1, i) - \frac{1}{\tau_k} * m_p(k-1, i)$$

$$mf_{cyl}(k, i) = (1 - X_k) * mf_{inj}(k, i) + \frac{1}{\tau_k} * m_p(k, i)$$

The amount of injected fuel $mf_{inj}$ is such that $mf_{cyl}$ is equal to the desired fuel mass $mf_{des}$, such that:

$$mf_{des}(k, i) = (1 - X_k) * mf_{inj}(k, i) + \frac{1}{\tau_k} * m_p(k, i)$$

Thus for each cylinder, the controller may keep a track of the puddle mass. Thus, using the calibrated X and Tau values as per the engine operating conditions, the controller may accurately compensate the amount of injected fuel such that the engine operates at stoichiometry (or another desired AFR) during transient operation.

As discussed earlier, for standard VDE and rolling VDE case based on the torque demand we have different induction ratios and each cylinder can either fire or skip i.e. be active for the current event or be deactivated. For a deactivated cylinder, with intake and exhaust valves deactivated, there is no airflow past the valves or intake runner. With no airflow in the runner, the evaporation rate of the puddle mass is different, in particular slower, than the values used in the look-up table for a regular firing cylinder. For a current skipped/deactivated event IC, a different time constant ($\tau_k$) is applied for the deactivated cylinder by referencing a different look-up table than the firing cylinder. In addition, note that $mf_{inj}(k,i)=0$ for a current deactivated cylinder.

Using the puddle fuel mass equation:

$$m_p(k, i) = m_p(k-1, i) - \frac{1}{\tau_k} * m_p(k-1, i)$$

the vapor build up in the intake runner for the deactivated cylinder may be given as:

$$m_{vap}(k, i) = \frac{1}{\tau_k} * m_p(k, i)$$

In this way, the controller may keep a track of the puddle mass and the vapor content in the runner for the deactivated cylinder on an event-by-event basis.

Returning to FIG. 3, at 326, the method includes calculating the saturation vapor pressure (SVP) and actual vapor pressure (VP) for the runner for the given event. Further a relative vapor percentage may be determined as a ratio of the actual vapor pressure relative to the SVP. For example, the controller may calculate the saturation vapor pressure (herein also referred to as the saturation limit) of the cylinder based on each of an alcohol content of injected fuel, a temperature of an intake port of the cylinder, and ambient pressure. The saturation vapor pressure may be increased/decreased as one or more of the alcohol content of the injected fuel increases, the ambient pressure increases, and the intake port temperature increases. At 328, the relative vapor percentage may be compared to a threshold. In one example, the threshold is 100%. If the relative vapor percentage is at 100%, it implies that the actual vapor pressure is at the saturation vapor pressure limit.

If the relative vapor percentage is below the threshold, then at 330, the method continues updating the puddle mass and fuel vapor content of the deactivated cylinder. In particular, the routine returns to 324 and resumes updating the puddle mass and fuel vapor content based on the new (e.g., second set of) time constant and gain values. Else, if the relative vapor percentage is at the threshold, then at 332, the method includes clipping the puddle mass and fuel vapor content values. In particular, the current state may be determined to be equal to the last determined value. In this way, the controller may estimate and update each of fuel puddle mass and fuel vapor content in an intake port of the deactivated cylinder on a cylinder event basis, and then maintain the (most recent) estimated fuel puddle mass and fuel vapor content after the estimated fuel vapor content reaches a saturation limit of the cylinder. The controller may then adjust fueling to the deactivated cylinder, upon reactivation, based on the estimated fuel puddle mass and fuel vapor content. For example, upon reactivation, the controller may adjust an amount of fuel that is port injected to the cylinder based on the estimated fuel puddle mass and fuel vapor content.

As the controller keeps track of the puddle mass and the vapor in the runner, the controller compares the vapor pressure in the runner to the saturation vapor pressure. This is because in most of the cases, if the cylinder is deactivated for extended periods, e.g. for multiple events, it cannot be assumed that all the puddle or film mass will eventually vaporize and be inducted in the next fire event. Depending on the port temperature and the MAP at which the engine is operating, the vapor pressure in the runner may reach a saturation limit after which further evaporation of the puddle mass may become limited.

The saturation vapor pressure of a fuel, for example gasoline, at a given intake port temperature may be calculated using the Antoine equation as follows:

$$SVP_{runner} = e^{A-\frac{B}{C+T_{port}}}$$

wherein: A, B and C are constants for the fuel type, Tport is the temperature of air in the intake, and Pv is the saturation vapor pressure.

Considering the mass of air in the runner (for the deactivated cylinder) at steady MAP and engine speed to be the same as the air charge for the inducting cylinder, the controller can then calculate the vapor pressure in the runner as follows:

$$VP_{runner} = \frac{MF(mf_{vap})}{MF(\text{air}) + MF(mf_{vap})} * MAP$$

where $MF(mf_{vap})$ is the mole fraction of evaporate puddle mass, MF(air) is the mole fraction of air, and MAP is the current manifold absolute pressure.

Using the saturation vapor pressure and the vapor pressure, the relative vapor concentration percentage in the runner can then be determined as:

$$Relativevapor\% = \frac{VP_{runner}}{SVP_{octane}} * 100$$

This value is compared against the threshold limit (such as 100%) to check if the vapor content in the runner has reached the saturation limit. If so, the mass of puddle and vapor content values for the deactivated cylinder are clipped. In other words, the mass of puddle and vapor content values for the deactivated cylinder are updated as long as the relative vapor percentage is below the threshold, and held at the last determined value once the relative vapor percentage is at the threshold. The values are held at the last determined values until the cylinder is reactivated and its state changes to a firing cylinder.

It will be appreciated that the controller may continue updating the fuel puddle estimation in each cylinder on a cylinder event (or cylinder cycle) basis as the induction state of the cylinder changes. Thus, following 320, if the active cylinder is deactivated, the fuel puddle state of the now deactivated cylinder may be tracked by transitioning from estimating via the model using the first set of model parameters to estimating using the second set of model parameters. Likewise, once the deactivated cylinder is reactivated, the fuel puddle state of the now active cylinder may be tracked by transitioning from estimating via the model using the second set of model parameters to estimating using the first set of model parameters.

As used herein, a cylinder event or cylinder cycle refers to completion of four strokes (intake, compression, power, and exhaust stroke) in a given cylinder. In comparison, an engine event or engine cycle refers to one the completion of a cylinder cycle for each cylinder of the engine. For example, in a four cylinder engine, an engine cycle is completed when each of the four cylinders have completed an intake stroke, a compression stroke, a power stroke, and an exhaust stroke.

In this way, an engine controller may adjust a fuel injection responsive to reaching a vapor saturation state in a port of a deactivated cylinder of the engine. In one example, adjusting the fuel injection includes adjusting fuel injection to the deactivated cylinder upon reactivation. In another example, adjusting the fuel injection includes adjusting fuel injection to other active cylinders of the engine on an individual cylinder basis while the deactivated cylinder is maintained deactivated. For example, the fuel injection may be adjusted tion first based on an increasing vapor release into the port of the deactivated cylinder over a plurality of successive cylinder cycles until the vapor saturation state is reached, and then subsequently based on non-increasing vapor release into the port of the deactivated cylinder. In another example, adjusting fuel injection to the active cylinders includes adjusting fuel injection based on vapor migration from the port of the deactivated cylinder into each of the active cylinders. The controller may estimate each of fuel puddle mass and vapor content in the port of the deactivated cylinder via a model, and indicate the vapor saturation state when the estimated vapor content reaches a saturation vapor pressure. The saturation vapor pressure may be estimated based on each of fuel alcohol content, ambient pressure, and port temperature of the deactivated cylinder. Further, the controller may estimate each of the fuel puddle mass and the vapor content in the port of the other active cylinders via the model. Therein, the controller may apply a first set of evaporation time constant and gain values for each of the active cylinders while applying a second, different set of evaporation time constant and gain values for the deactivated cylinder.

An example of tracking the fuel vapor content of a deactivated cylinder and clipping the vapor content once the vapor pressure reaches a saturation limit is shown in the example of FIG. 6. Map 600 depicts desired fuel mass for a cylinder at 610, wherein plots 602-606 depict different amount of fuel injection masses. Map 600 depicts the updated film mass at 620, wherein plots 612-616 depict the mass of fuel in the puddle for three different fuel injection masses represented by 602, 604 and 606 respectively. Map 600 also depicts the relative vapor percentage at 630, wherein plots 622-626 depict the relative saturation vapor pressures in the runners. All plots are depicted over time along the x-axis. For the injection of mass 602, the puddle mass of 612 causes vapor pressure 622 to be higher than 100% indicating that the fuel evaporation will reach limiting condition. For the cases of fuel injection masses 604 and 606, the puddle mass is low enough (614, 616) to not exceed relative vapor pressure (624, 626) to be above 100% and hence not limiting the evaporation of fuel.

Figure 7:
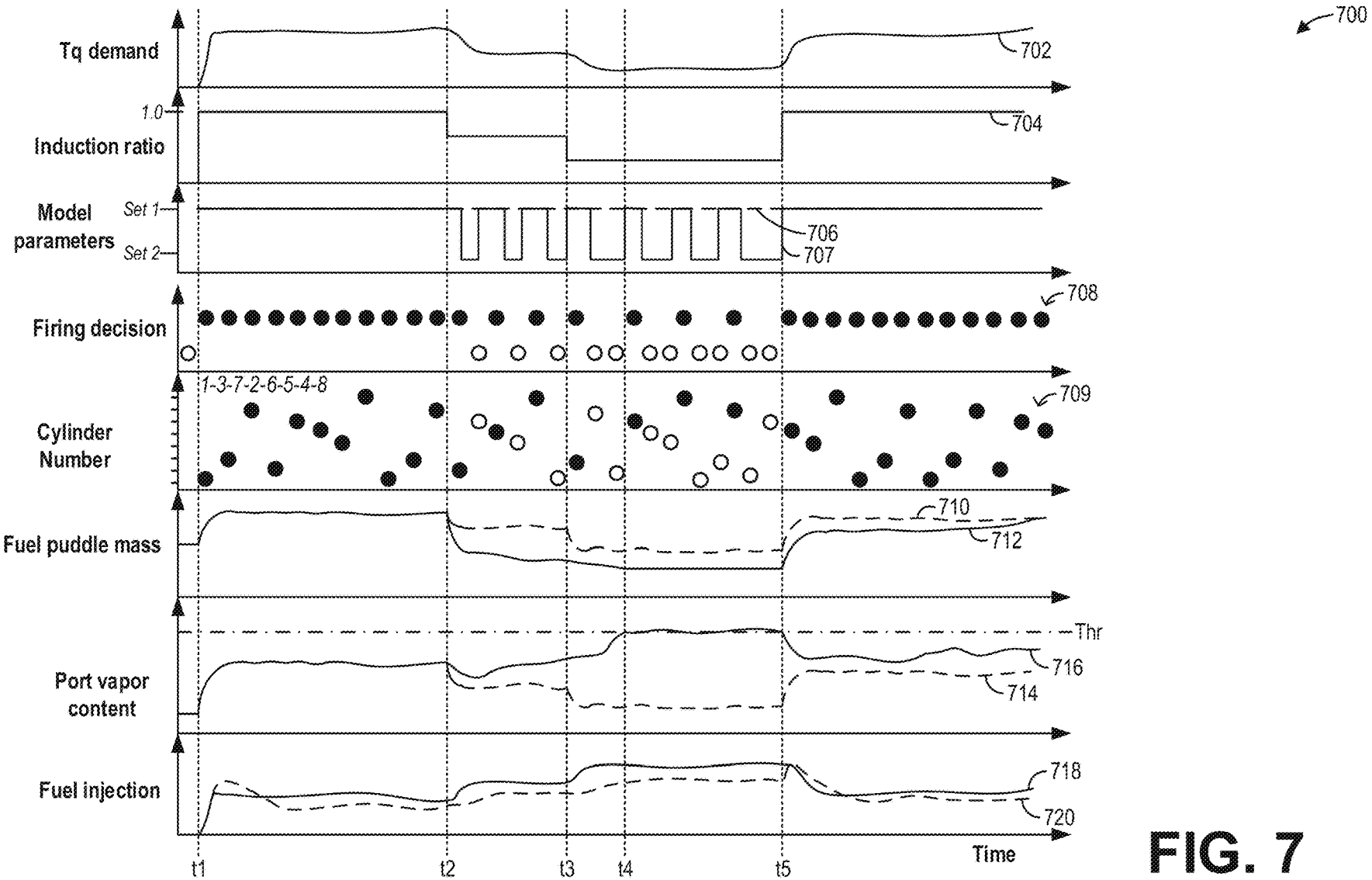
FIG. 7 shows a prophetic example of adjusting cylinder fueling in a variable displacement engine while taking into account changes in fuel puddle mass with change in induction state.

Turning now to FIG. 7, an example map 700 of updating an intake port fuel puddle mass based on the activation state of a cylinder and adjusting engine fueling in accordance is shown. Map 700 depicts torque demand at plot 702, induction ratio at plot 704, and model parameter selection for a first (active) cylinder at plot 706 (dashed line), as compared to the selection for a second (deactivated) cylinder at plot 707 (solid line). The model parameters selected may include a time constant and a gain value, for example. Map 700 depicts a cylinder firing decision at plot 708 and cylinder number for each cylinder event at plot 709. Map 700 further depicts changes to an intake port fuel puddle mass for the first cylinder at plot 710 (dashed line) and for the second cylinder at plot 712 (solid line). The intake port vapor content for the first cylinder is shown at plot 714 (dashed line) and for the second cylinder at plot 716 (solid line), both in relation to a saturation vapor pressure limit (Thr). The desired fuel mass, based on the torque demand, in the first cylinder is shown at plot 718 (solid line) while the actual amount of fuel injected, while accounting for the fuel puddle and vapor content is shown at plot 720 (dashed line). It may be noted that for the case of deactivated cylinder with induction ratio 704, fuel puddle mass evaporates (712) to saturation vapor pressure (716) and is clipped at the vapor pressure threshold Thr. All plots are shown over time (and engine events) along the x-axis.

The depicted example is for an eight cylinder four stroke engine (with cylinders 1-8) having a firing order (or order of combustion) of 1, 3, 7, 2, 6, 5, 4, 8. An engine event (herein also referred to as an engine cylinder event) may be a stroke of a cylinder occurring (e.g., intake, compression, power, exhaust), an intake or exhaust valve opening or closing time, time of ignition of an air-fuel mixture in the cylinder, a position of a piston in the cylinder with respect to the crankshaft position, or other engine related event. Cylinder events are shown in their firing order. If a particular cylinder in the firing order is fired, it shown at plot 708 as a solid circle. If a particular cylinder in the firing order is skipped, it is shown at plot 708 as an empty circle. Plot 709 depicting the firing decision is reflective of a selected firing pattern wherein a cylinder activation event (e.g., firing with intake and exhaust valves opening and closing during a cycle of the cylinder) is represented by a filled circle and a cylinder deactivation event (e.g., not firing with intake and exhaust valves held closed during a cycle of the cylinder) is indicated by an empty circle. The decision to activate or deactivate a cylinder and open and close the cylinder's intake and exhaust valve may be made a predetermined number of cylinder events (e.g., one cylinder event, or alternatively, one cylinder cycle or eight cylinder events for an eight cylinder engine) before the cylinder is to be activated or deactivated to allow time to begin the process of opening and closing intake and exhaust valves of the cylinder being evaluated. For example, for an eight cylinder engine with a firing order of 1, 3, 7, 2, 6, 5, 4, 8, the decision to activate or deactivate cylinder number seven may be made during an intake or compression stroke of cylinder number seven one engine cycle before cylinder number seven is deactivated. Alternatively, the decision to activate or not activate a cylinder may be made a predetermined number of engine events or cylinder events before the selected cylinder is activated or deactivated. The cylinder on its compression stroke at the time corresponding to the cylinder event is activated when the firing decision is indicated by the filled circle (and the firing decision value is at 1). The cylinder on its compression stroke at the time corresponding to the event number is not activated when the firing decision is indicated by the empty circle (and the firing decision value is at zero).

Prior to t1, the engine is shut down. At t1, responsive to an increase in torque demand (such as due to a pedal tip-in), the engine is started. Due to the high torque demand (plot 702), the induction ratio selected at t1 is 1.0 (plot 704). That is, the engine is operated with all cylinders active. Between t1 and t2, while the engine is operated with all cylinders firing, the fuel puddle mass (plots 710, 712) and port vapor content (plots 714, 716) for each of a first and a second cylinder are tracked via a fuel puddle estimation model that uses a first set of model parameters (plot 706, 707). In addition, fuel injection to the first cylinder (shown at plot 720) and the second cylinder (not shown) is adjusted based on estimated fuel puddle mass and vapor content so that a desired fuel mass (plot 718) that enables a target AFR (such as stoichiometry) can be provided. For example, soon after the tip-in, fuel is injected to the first cylinder is excess of the desired fuel mass to account for some of the fuel that is retained in the intake port to replenish to the fuel puddle. Then, once the fuel puddle is established, fuel is injected to the first cylinder that is less than the desired fuel mass to account for some of the fuel that is drawn into the intake port from the fuel puddle.

At t2, responsive to a decrease in torque demand (such as due to a pedal tip-out), the induction ratio is lowered (for example, from 1.0 to 0.5). That is, the engine is operated with some of the cylinders selectively deactivated, specifically with every alternate cylinder deactivated. The induction ratio of 0.5 is provided by a stationary pattern where the identity of deactivated cylinders over consecutive cycles stays the same (e.g., in this case, cylinders 1, 6, and 4 will be skipped while cylinders 2, 5, and 8 will be fired each cycle). In the depicted example, the first cylinder (which may be cylinder 8 for example) is maintained active while the second cylinder (which may be cylinder 1, for example) is deactivated responsive to the drop in torque demand. The second cylinder may be deactivated by deactivating fuel delivery to the cylinder and disabling cylinder valve operation.

Between t2 and t3, the fuel puddle mass and port vapor content for the first cylinder, which is active, continues to be tracked via the fuel puddle estimation model while using the first set of model parameters. However, to account for the slower evaporation rate from the now deactivated cylinder, the fuel puddle mass and vapor content for the second cylinder is tracked via the fuel puddle estimation model while using a second set of model parameters, different from the first set of model parameters. In one example, the second set includes a time constant and gain value that is smaller than those included in the first set. In the depicted example, following the deactivation, the fuel puddle mass in the second cylinder starts to drop as the fuel evaporates into the intake port. At the same time, the fuel vapor content starts to rise due to a portion of the liquid phase fuel from the fuel puddle transitioning to the vapor phase.

Also between t2 and t3, fuel injection to the first cylinder continues to be adjusted based on estimated fuel puddle mass and vapor content so that the desired fuel mass can be provided. While the torque demand decreases, due to a fewer number of cylinders operating active, the load on the first cylinder is increased to improved engine performance, and accordingly, the fuel mass desired in the first cylinder increases. In the depicted example, since the fuel puddle is established, between t2 and t3, fuel is injected to the first cylinder that is less than the desired fuel mass to account for some of the fuel that is drawn into the intake port from the fuel puddle, as well as to account for fuel vapors migrating from the deactivated second cylinder into the intake port of the active first cylinder.

At t3, responsive to a further decrease in torque demand, the induction ratio is lowered further (for example, from 0.5 to 0.33). That is, the engine is operated with more of the cylinders selectively deactivated. Herein, the engine is operated with every third cylinder being fired. The induction ratio of 0.33 is provided by a non-stationary pattern where the identity of active cylinder and deactivated cylinder varies over consecutive cycles (e.g., in this case, cylinders 3 and 6 are fired in the first cycle but are skipped in the next cycle). In the depicted example, the first cylinder (e.g., cylinder 8) continues to be active while the second cylinder (e.g., cylinder 1) continues to be deactivated responsive to the further drop in torque demand. While the torque demand decreases, due to an even fewer number of cylinders operating active, the load on the first cylinder is further increased to improved engine performance, and accordingly, the fuel mass desired in the first cylinder increases. Fuel puddle and vapor content estimation in the first and second cylinder continues using the first and second set of model parameters, respectively, and fuel injection to the first cylinder continues to be updated based on the fuel puddle dynamics of the first cylinder's intake port.

At t4, while still deactivated, the fuel vapor content of the second cylinder reaches a saturation limit Thr. Herein, the saturation limit corresponds to a saturation vapor pressure of the injected fuel in the intake port of the second cylinder, the saturation vapor pressure determined as a function of the fuel in the fuel puddle (e.g., the alcohol content of the fuel, the octane rating of the fuel, etc.) as well as the temperature of the intake port of the second cylinder. As such, once the saturation limit is reached, further evaporation of fuel from the intake port of the second cylinder becomes limited. Therefore at t4, the estimated fuel puddle mass and vapor content values are clipped. Specifically, the most recent values of the fuel puddle mass and vapor content, estimated immediately prior to t4, are maintained while the cylinder remains deactivated. At the same time, the fuel puddle mass and vapor content of the first cylinder continues to be updated.

At t5, responsive to an increase in torque demand (such as due to a pedal tip-in), the induction ratio is raised (for example, from 0.5 to 1.0), and the engine is operated with all cylinders active. That is, while the first cylinder continues to be active, the second cylinder is reactivated responsive to the increase in torque demand. Accordingly, fuel puddle and vapor content estimation in the second cylinder using the first set of model parameters is resumed, while fuel puddle and vapor content estimation in the first cylinder using the first set of model parameters is continued. While the torque demand increases, due to a larger number of cylinders operating, the load on the first cylinder is decreased, and accordingly, the fuel mass desired in the first cylinder decreases. Fuel injection to the first cylinder continues to be updated based on the fuel puddle dynamics of the first cylinder's intake port. For example, fueling to the first cylinder is increased to account for the lower amount of fuel vapors migrating to the first cylinder from the second cylinder. Fuel injection to the second cylinder is updated when cylinder fueling is resumed to account for the fuel puddle dynamics of the second cylinder's intake port (not shown). For example, fuel may be delivered to the second cylinder in excess of the desired fuel mass to account for fuel that may be lost to the intake port of the second cylinder to establish the fuel puddle (and other related wall wetting losses).

In this way, the example of FIG. 7 shows how, responsive to selective deactivation of an engine cylinder, an engine controller may adjust each of a fuel puddle mass and a fuel vapor content in an intake port of the deactivated cylinder on each skipped cylinder event; and when the fuel vapor content reaches a threshold, the controller may maintain the fuel puddle mass and the fuel vapor content until the cylinder is reactivated. As an example, the threshold may be a function of a saturation limit of the cylinder, the saturation limit estimated based on an alcohol content of injected fuel and a temperature of an intake port of the deactivated cylinder. The saturation limit may be raised as the temperature or the alcohol content increases. Further, the controller may adjust each of a fuel puddle mass and a fuel vapor content in an intake port of an active cylinder on each cylinder event based on a first evaporation time constant and a first gain value. In comparison, the adjusting each of the fuel puddle mass and the fuel vapor content in the intake port of the deactivated cylinder may be based on each of a second evaporation time constant and a second gain value. The controller may calculate each of the first evaporation time constant and the first gain value as a function of engine speed and load. Further, responsive to reactivation of the deactivated cylinder, the controller may adjust at least an amount of port injected fuel delivered to the cylinder based on the maintained fuel puddle mass and the fuel vapor content. In some examples, such as where the engine is a PFDI engine, the controller may also adjust an amount of direct injected fuel delivered to the cylinder based on the maintained fuel puddle mass and fuel vapor content to operate the engine at a desired air-fuel ratio.

In this way, fuel puddle mass and fuel vapor content of an intake runner of each cylinder of a PFI or PFDI engine system can be better tracked. The technical effect of using a distinct look-up table including distinct time constant and gain values for a deactivated cylinder, relative to an active cylinder, is that the difference in evaporation rates for a firing cylinder versus a skipped cylinder can be better accounted for during transient fuel puddle compensation. By tracking the vapor build-up in a deactivated cylinder and comparing the vapor pressure to a saturation pressure limit, the status of the puddle or film mass in the intake may be better determined. In particular, by clipping the vapor content once the tracked vapor pressure reaches the saturation pressure limit, errors in fuel puddle estimation are reduced, reducing fueling errors and associated AFR perturbations during torque transients.

One example method for an engine comprises: adjusting a fuel injection responsive to reaching a vapor saturation state in a port of a deactivated cylinder of the engine. In the preceding example, additionally or optionally, adjusting the fuel injection includes adjusting fuel injection to the deactivated cylinder upon reactivation. In any or all of the preceding examples, additionally or optionally, adjusting the fuel injection includes adjusting fuel injection to other active cylinders of the engine on an individual cylinder basis while the deactivated cylinder is maintained deactivated. In any or all of the preceding examples, additionally or optionally, adjusting the fuel injection includes adjusting the fuel injection first based on an increasing vapor release into the port of the deactivated cylinder over a plurality of successive cylinder cycles until the vapor saturation state is reached, and then subsequently based on non-increasing vapor release into the port of the deactivated cylinder. In any or all of the preceding examples, additionally or optionally, adjusting fuel injection to the active cylinders includes adjusting fuel injection based on vapor migration from the port of the deactivated cylinder into each of the active cylinders. In any or all of the preceding examples, additionally or optionally, the method further comprises estimating each of fuel puddle mass and vapor content in the port of the deactivated cylinder via a model, and indicating the vapor saturation state when the estimated vapor content reaches a saturation vapor pressure. In any or all of the preceding examples, additionally or optionally, the saturation vapor pressure is estimated based on each of fuel alcohol content, ambient pressure, and port temperature of the deactivated cylinder, the method further comprising estimating each of the fuel puddle mass and the vapor content in the port of the other active cylinders via the model. In any or all of the preceding examples, additionally or optionally, the estimating via the model includes applying a first set of evaporation time constant and gain values for each of the active cylinders and applying a second, different set of evaporation time constant and gain values for the deactivated cylinder, the evaporation time constant and gain values in the first set being smaller than the evaporation time constant and gain values in the second set. In any or all of the preceding examples, additionally or optionally, adjusting the fuel injection includes adjusting port fuel injection via adjustments to a pulse-width commanded to a port fuel injector.

Another example method comprises: responsive to selective deactivation of an engine cylinder, updating an estimate for fuel puddle mass and vapor content in an intake port of the deactivated cylinder on each skipped cylinder event until a vapor saturation limit is reached; and thereafter maintaining the estimate until the cylinder is reactivated; and adjusting fuel injection to the cylinder upon reactivation based on the maintained estimate. In the preceding example, additionally or optionally, the vapor saturation limit is based on an alcohol content of injected fuel, ambient pressure, and a temperature of the intake port of the deactivated cylinder. In any or all of the preceding examples, additionally or optionally, the method further comprises updating the estimate for fuel puddle mass and vapor content in an intake port of another active cylinder on each cylinder event via a model using a first evaporation time constant and a first gain value, wherein the updating for the deactivated cylinder is via the model using a second, different evaporation time constant and a second, different gain value. In any or all of the preceding examples, additionally or optionally, the method further comprises selecting the first and second evaporation time constant and the first and second gain value as a function of engine speed and load, and further based on induction state. In any or all of the preceding examples, additionally or optionally, the method further comprises adjusting fuel injection to the active cylinder based on the estimate for fuel puddle mass and vapor content in the intake port of the active cylinder, and further based on migration of fuel vapor from the intake port of the deactivated cylinder into the intake port of the active cylinder. In any or all of the preceding examples, additionally or optionally, the updating includes decreasing the estimate for the fuel puddle mass and increasing the estimate for the vapor content in the intake port on each skipped cylinder event until the vapor saturation limit is reached.

Another example engine system comprises: a first cylinder; a second cylinder; a first fuel injector coupled to a first intake port of the first cylinder; a second fuel injector coupled to a second intake port of the second cylinder; and a controller with computer readable instructions stored on non-transitory memory for, responsive to a drop in torque demand, selectively deactivating the second cylinder while continuing to fuel the first cylinder for a number of cylinder events; and on each event for the number of cylinder events, updating a value of a first fuel puddle in the first intake port via a first set of fuel evaporation constants; updating a value of a second fuel puddle in the second intake port via a second, different set of fuel evaporation constants until the fuel puddle is at a saturation limit, and then maintaining the value of the second fuel puddle; and adjusting a pulse-width commanded to the first fuel injector based on the value of the first fuel puddle. In the preceding example, additionally or optionally, the controller includes further instructions for, responsive to a rise in the torque demand, reactivating the second cylinder; and adjusting the pulse-width commanded to the second fuel injector based on the value of the second fuel puddle. In any or all of the preceding examples, additionally or optionally, updating the value of the first fuel puddle in the first intake port includes updating each of a fuel puddle mass and a fuel vapor pressure in the first intake port, wherein updating the value of the second fuel puddle in the second intake port includes updating each of the fuel puddle mass and the fuel vapor pressure in the second intake port, and wherein the fuel puddle being at the saturation limit includes the fuel vapor pressure in the second intake port being at a saturation vapor pressure. In any or all of the preceding examples, additionally or optionally, the controller includes further instructions for calculating the saturation vapor pressure based on each a fuel alcohol content, a temperature of the second intake port, and ambient pressure. In any or all of the preceding examples, additionally or optionally, the controller includes further instructions for retrieving the first set of fuel evaporation constants from the memory as a function of engine speed and load; and calculating the second set of fuel evaporation constants from the first set of fuel evaporation constants by applying a forgetting factor.

In a further representation, a method for an engine comprises: estimating each of fuel puddle mass and fuel vapor content in an intake port of each cylinder on a cylinder event basis including based on an induction state of each cylinder; and for a deactivated cylinder, maintaining the estimated fuel puddle mass and fuel vapor content after the estimated fuel vapor content reaches a saturation limit of the cylinder. In the preceding example, additionally or optionally, the estimated fuel puddle mass and fuel vapor content is maintained until the deactivated cylinder is reactivated. In any or all of the preceding examples, additionally or optionally, the method further comprises adjusting fueling to an active cylinder the based on the estimated fuel puddle mass and fuel vapor content, and adjusting fueling to the deactivated cylinder, upon reactivation, based on the estimated fuel puddle mass and fuel vapor content. In any or all of the preceding examples, additionally or optionally, adjusting fueling includes adjusting an amount of fuel that is port injected based on the estimated fuel puddle mass and fuel vapor content. In any or all of the preceding examples, additionally or optionally, the estimating further includes estimating a migration of fuel from the deactivated cylinder to an active cylinder of the engine. In any or all of the preceding examples, additionally or optionally, the estimating includes estimating via a model, and wherein the estimating based on the induction state includes applying a first set of model parameters when a cylinder is active and applying a second, different set of model parameters when the cylinder is deactivated, the model parameters including one or more of a fuel evaporation time constant and gain value. In any or all of the preceding examples, additionally or optionally, the evaporation time constant and gain value in the first set is smaller than the evaporation time constant and gain value in the second set. In any or all of the preceding examples, additionally or optionally, applying the first set of model parameters includes retrieving the first set from a memory of an engine controller, and wherein applying the second set includes using a forgetting factor to calculate the second set of model parameters from the first set of parameters. In any or all of the preceding examples, additionally or optionally, first set of model parameters are based on engine speed and manifold pressure and the second set of model parameters are based on number of events of cylinder deactivation. In any or all of the preceding examples, additionally or optionally, the method further comprises calculating the saturation limit of the cylinder based on an alcohol content of injected fuel and a temperature of an intake port of the cylinder. In a further representation, the engine system is coupled in a hybrid electric vehicle.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for controlling a direct fuel injector of an internal combustion engine, comprising:

with an electronic controller:

responsive to selective deactivation of an engine cylinder, generating an estimate for fuel puddle mass and vapor content in an intake port of the deactivated cylinder on each skipped cylinder event based on sensed operating parameters;

updating the estimated fuel puddle mass and vapor content until a vapor saturation limit is reached; and thereafter after determining that the vapor content in the intake port reaches the vapor saturation limit, maintaining the estimated fuel puddle mass and vapor content until the deactivated cylinder is reactivated; and adjusting an amount of fuel injection to the cylinder upon reactivation based on the maintained estimated fuel puddle mass and vapor content.

2. The method of claim 1, wherein the vapor saturation limit is based on an alcohol content of injected fuel, ambient pressure, and a temperature of the intake port of the deactivated cylinder.

3. The method of claim 2, further comprising, updating the estimate for fuel puddle mass and vapor content in an intake port of another active cylinder on each cylinder event via a model using a first evaporation time constant and a first gain value, wherein the updating for the deactivated cylinder is via the model using a second, different evaporation time constant and a second, different gain value.

4. The method of claim 3, further comprising:

selecting the first evaporation time constant and the first gain value as a function of engine speed and manifold pressure; and applying a forgetting factor to the first evaporation time constant and the first gain value to calculate the second evaporation time constant and the second gain value.

5. The method of claim 3, further comprising adjusting fuel injection to the active cylinder based on the estimate for fuel puddle mass and vapor content in the intake port of the active cylinder, and further based on migration of fuel vapor from the intake port of the deactivated cylinder into the intake port of the active cylinder.

6. The method of claim 1, wherein the updating includes decreasing the estimate for the fuel puddle mass and increasing the estimate for the vapor content in the intake port on each skipped cylinder event until the vapor saturation limit is reached.

* * * * *